United States Patent [19]

Myers

[11] Patent Number: 4,911,205

[45] Date of Patent: Mar. 27, 1990

[54] APPARATUS AND METHOD FOR DUCT VANE MOUNTING

[76] Inventor: Jerome J. Myers, 7570 Mariner Dr., Maple Grove, Minn. 55369

[21] Appl. No.: 177,627

[22] Filed: Apr. 5, 1988

[51] Int. Cl.[4] ..... F15D 1/04

[52] U.S. Cl. ..... 138/39; 29/890.14; 138/37

[58] Field of Search ..... 138/37, 39, DIG. 4; 98/DIG. 7, 40.2, 121.1; 29/157 R, 156.8 R, 439, 453, 462; 110/322

[56] References Cited

U.S. PATENT DOCUMENTS

| | | | |
|---|---|---|---|
| 1,028,829 | 6/1912 | Reuterdahl | 138/162 |
| 1,355,213 | 10/1920 | Chipperfield | 312/257 R |
| 2,292,246 | 8/1942 | Steffens | 138/39 |
| 2,861,597 | 11/1958 | Gracer | 138/39 |
| 2,884,956 | 5/1959 | Perlin | 138/39 |
| 3,050,160 | 8/1962 | Chesser | 189/36 |
| 3,075,450 | 1/1963 | Noll | 98/46 |
| 3,144,204 | 8/1964 | Bohanon | 230/134 |
| 3,224,668 | 12/1965 | Olmsted et al. | 230/134 |
| 3,381,713 | 5/1968 | Jacobsen | 138/39 |
| 3,405,737 | 10/1968 | Harper | 138/39 |
| 3,455,008 | 7/1969 | Harper | 29/208 |
| 3,602,262 | 8/1971 | Hinden | 138/39 |
| 4,586,540 | 5/1986 | DeLord | 139/39 |
| 4,641,684 | 2/1987 | DeLord | 137/561 |

*Primary Examiner*—Henry J. Recla
*Assistant Examiner*—Glenn T. Barrett
*Attorney, Agent, or Firm*—Kinney & Lange

[57] ABSTRACT

A duct vane assembly has a rail for supporting a flow diverting vane perpendicularly therefrom. The rail has at least one upstanding tab for each vane which is adapted for insertion longitudinally into a slot defined by a lateral strap formed on the vane adjacent its end. A finger on the tab projects into an opening on the vane adjacent the strap to affirmatively retain the vane in connected relation to the rail.

16 Claims, 1 Drawing Sheet

APPARATUS AND METHOD FOR DUCT VANE MOUNTING

BACKGROUND OF THE INVENTION

1. Field of the Invention

The present invention relates to an apparatus for holding guide vanes such as bowed turning vanes in a duct, and a method for assembly of such vanes onto support rails therefor.

2. Description of the Prior Art

Turning vanes are used to direct moving gases around duct corners where the ends of two ducts positioned at right angles intersect, such as heating or ventilation air ducts. If vanes are not used, air strikes the wall of the intersecting duct. This can cause turbulence or backflow in the duct. The vanes are positioned diagonally across the duct corner region to guide the air flow smoothly around the corner.

A commonly used turning vane is constructed by joining two pieces of curved sheet metal, having different radii of curvature, at their edges. This results in a hollow vane, with a crescent-shaped cross section. A single sheet of curved sheet metal has also been used as a vane, having only a single thickness in bowed cross section. Such vanes, whether of single or double wall construction, can be cut to whatever length is needed in a duct.

Positioning and fastening of vanes in an assembly which permits proper positioning in a duct has been an expensive and labor-intensive process. Many techniques for fastening vanes to a pair of opposed parallel sheet metal rails or to the ducts themselves have been tried. For the most part, these techniques have been unsatisfactory because they involve special fasteners, additional labor-intensive steps or expensive tooling on the sheet metal. Fastening techniques using special fasteners are unsuitable because such fasteners are quite expensive in relation to the cost of the end product. Relative labor costs also become expensive when extra labor-intensive activities are required to fasten a vane to a rail.

The present invention fulfills the need for a duct vane mounting assembly method and apparatus which does not require special fasteners, which can be inexpensively produced and which requires minimal labor for the attachment of the turning vanes to a support rail or rails.

SUMMARY OF THE INVENTION

The present invention is designed for use with a duct vane which has a single panel of laterally bowed sheet metal. A rail for supporting said duct vane in a generally perpendicular relation thereto has at least one upstanding tab thereon which is adapted for insertion longitudinally into a lateral strap on the vane adjacent one end thereof. The tab has means for affirmatively engaging the vane adjacent the strap to retain the rail in connected relation to the vane.

Preferably, the duct vane has a plurality of lateral straps adjacent its one end and the rail has a corresponding plurality of upstanding tabs aligned in an arc for insertion into said straps of the vane and engagement with the vane adjacent thereto. For connecting the vane to rails at both ends thereof, the one end of the duct vane is a first end and the duct vane has a second end longitudinally spaced apart therefrom with a second lateral strap on the vane adjacent the second end thereof. A second rail is provided for the second end of the vane, with the second rail also having at least one second upstanding tab thereon which is adapted for insertion longitudinally into the second lateral strap of the vane adjacent its second end. The second tab has means for affirmatively engaging the vane adjacent the second strap to retain the second rail in connected relation thereto, generally parallel to the rail at the first end of the vane. Preferably, each rail has a plurality of upstanding tabs aligned thereon to support a plurality of generally parallel, spaced apart duct vanes.

In a preferred embodiment, the strap is formed integrally with the vane from a strip of the vane between two parallel slots cut laterally through the vane. The strap has first and second ends integral with the vane and is spaced outwardly from the vane between the ends, thereby leaving a lateral opening in the vane defined by the first and second ends of the strap and the two parallel slots in the vane. On the tab, the means for engaging is a finger extending outwardly from the tab which is received in the lateral opening in the vane when the tab is inserted into the strap, with an outer end of the finger adapted to engage the slot of the vane closest to the one end of the vane. Preferably, the finger is formed integrally from the tab, and the tab is formed integrally from the rail.

A method of assembling a laterally bowed duct vane perpendicular to a rail having an upstanding tab thereon includes the steps of first forming a lateral strap from a panel of the duct vane adjacent an end thereof, inserting the tab longitudinally between the vane panel and lateral strap thereon, and engaging a portion of the tab with a portion of the vane panel adjacent the strap to secure the vane in connected relation to the rail.

DETAILED DESCRIPTION OF THE PREFERRED EMBODIMENTS

Figure 1:
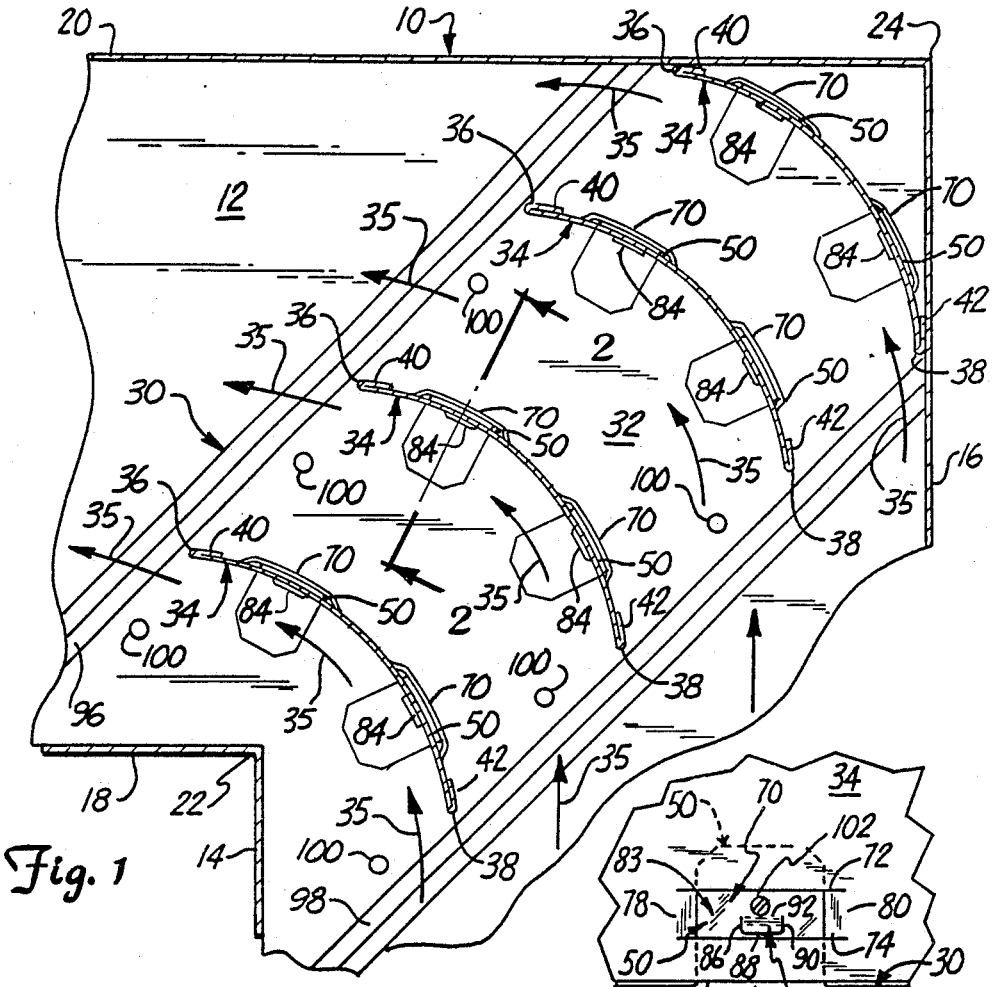
FIG. 1 is a sectional view of a duct with a plurality of vanes mounted on a rail in accordance with my invention.

A right angle turn in a duct 10 is shown in cross section in FIG. 1. The duct 10 has a back wall 12, parallel side walls 14 and 16, and parallel side walls 18 and 20 (which are perpendicular and joined to the side walls 14 and 16, respectively). The side walls 18 and 14 meet at inner corner 22, while the side walls 16 and 20 meet at outer corner 24.

A rail 30 has a base sheet or wall 32 which is mounted flush to back wall 12 of the duct 10 and extends from corner 22 to corner 24, as shown in FIG. 1, typically at a 45° angle. A plurality of duct turning vanes 34 are mounted to the sheet 32 of the rail 30 to extend therefrom perpendicularly, as seen in FIG. 1. The vanes 34 are formed from a single sheet bowed laterally from side edge 36 to side edge 34. As bowed, the vanes 34 are designed to divert air flow through a turning corner of the duct 10 (as illustrated by arrows 35 in FIG. 1). The vanes 34 extend across the entire duct 10 longitudinally from end to end of each vane 34. At each end thereof, the vane 34 is mounted to a rail 30, as explained below and seen in FIG. 2. For stiffening purposes, portions of the vane adjacent its side edges 36 and 38 are folded over to form hems 40, 42. In the example illustrated, all portions of the duct 10, rail 30 and vane 34 are formed from sheet metal.

Figure 4:
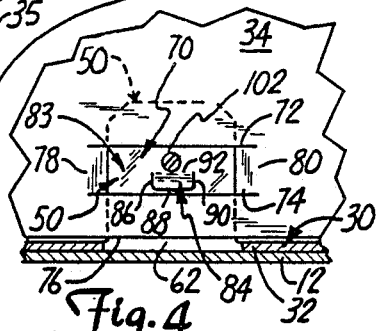
FIG. 4 is a fragmentary sectional view as taken along lines 4—4 in FIG. 3.
Figure 2:
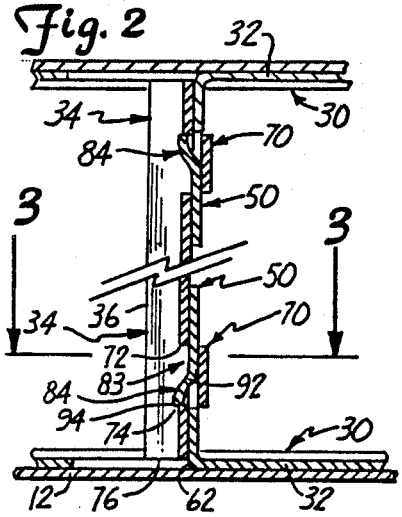
FIG. 2 is a fragmentary sectional view as taken along lines 2—2 in FIG. 1.
Figure 3:
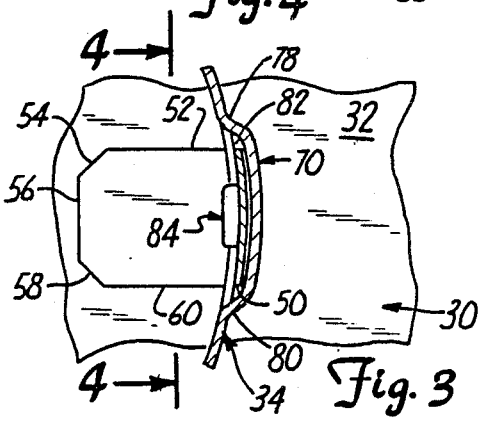
FIG. 3 is a fragmentary sectional view as taken along lines 3—3 in FIG. 2.

Depending from and integral with the base sheet 34 of the rail 30 is a plurality of vane guide tabs 50 cut and bent away from the sheet 34. As seen in FIGS. 2, 3 and 4, the tab 50 is formed from the sheet 32 by cutting along lines 52, 54, 56, 58 and 60, and bending the cut out tab 50 along bend line 62 into a perpendicular upstanding relation relative to the sheet 32. As seen in FIG. 1, each sheet 32 has a plurality of tabs 50 extending therefrom. For each vane 34, there may be a plurality of tabs 50, disposed in an arc laterally across the sheet 32 to accommodate the laterally bowed vane 34. In addition, each rail has a plurality of tabs 50 thereon to support a plurality of vanes 34, such as shown in FIG. 1. The tabs 50 are aligned on the sheet 32 to support the vanes 34 in position to divert air through a corner of the duct 10, with the vanes aligned generally parellel across the air flow of the duct 10, which is illustrated by arrows 35 in FIG. 1.

As seen in FIGS. 2–4, each vane 34 has at lest one strap 70 adjacent each end thereof. The strap 70 is formed integrally with the vane 34, by cutting two parallel slots or edges 72, 74 in the vane 34, laterally across the vane 34 and spaced from its end edge 76. As seen in FIG. 4, the slots 72 and 74 are of generally equilateral length across the vane 30, extending from a first strap end 78 to a second strap end 80. As seen in FIGS. 2 and 3, the strap 70 is bent adjacent its ends 78 and 80 so that portions of the strap 70 therebetween are spaced outwardly from the vane 34 and generally trace the bowed arc of the vane 34 across its lateral dimension. The strap 70 and vane 34 thus combine to form an opening or slot 82 therebetween adapted for acceptance of the tab 50 of the rail 30 (see FIG. 2). By bending the strap 70 outwardly from the vane 34, a laterally disposed opening 83 is left in the vane 34, defined by the slots 72 and 74 and strap ends 78 and 80 (see FIGS. 2 and 4).

A finger 84 formed integrally from the tab 50 projects outwardly from the tab 50, on the side thereof adapted to face the vane 34 when the vane 34 and rail 30 are assembled, as seen in FIG. 2. The finger 84 is formed in the tab 50 by cutting along lines 86, 88 and 90 through the tab 50 (see FIG. 4) and bending the finger 84 defined by those lines outwardly from the tab 50 along bend line 92. When the vane 34 is mounted on the tab 50, the opening 83 is aligned to receive the finger 84 therein. The finger 84 is resilient with respect to the tab 50 so that during insertion of the tab 50 into the slot 82 defined by the vane 34 and strap 70, the finger 84 is "flattened" against the tab 50 and springs out into the opening 83 of the vane 34 when the vane 34 and rail 30 are assembled as seen in FIG. 2. An outer end 94 of the finger 84 projects outwardly from the tab 50 sufficient to engage the edge or slot 74 of the vane 34, thereby affirmatively retaining the vane 34 into a coupled position with the rail 30. The vane 34 is thus "locked" into engagement with the rail 30. The vane 34 and rail 30 are assembled without the use of any extra tools, but simply by pushing them together so that the tab 50 of the rail 30 is fully received within the slot 82 formed between the vane 34 and strap 70.

When constructed according to the present invention, a rail can be quickly and easily connected to the single sheet turning vanes to asemble any needed configuration. No special fasteners are needed. This not only saves money, but limits the number of necessary parts to be assembled. Special fasteners need not be stocked and available at the point of connection. No special tools are required for any assembly operation, nor is any extra labor required other than simply "snapping" each end of the vane onto its respective rail.

The assembly operation involves simply aligning the end of a vane 34 with its respective tab or tabs 50. The vane 34 is aligned so that the tabs are insertable into the slots 82 of the vane 34. The vane 34 is pushed down longitudinally onto the rail 30 until its end edge 76 engages the base sheet 32 of the rail 30 and the finger 84 of each tab 50 springs outwardly into the opening 83 on the vane 34. During insertion, the end edge 76 of the vane pushes against a top ramp-like surface of the finger 84 and urges it against the tab 50 until it reaches the opening 83 in the vane 34. Once the finger 84 springs back to its vane locking position (seen in FIG. 2), the vane 34 is then affirmatively engaged to the rail 30. These assembly steps are repeated for each end of each vane until a vane and rail assembly is formed as desired. The assembly is then mounted in a duct as appropriate.

While in the preferred embodiment, the rails and vanes are formed from bendable sheet metal, the invention can be practiced with vanes and rails of any shape and construction, as long as the strap 70 may be formed on the vane and the tab 50 and finger 84 may be formed from the rail. The result is a method of construction which is faster, easier and cheaper than prior art methods. The rail 30 constructed according to the present invention can be inexpensively fabricated from a single sheet of sheet metal, as can each vane 34 as well. Further, while only single sheet vanes are shown, the duct vane mounting assembly of the present invention works equally as well as with double wall vanes, wherein one wall or panel of a double wall vane has the straps formed therein.

In forming the rail and vane components of the present invention, there are some relative dimensions that are important for operation of the present invention to be successful. The rail is typically cut and preformed by means of a hydraulic press. For stiffening purposes, side ridges 96 and 98 are formed along the edges of the rail. In addition, the tabs 50 and fingers 84 thereon are cut by hydrualic press. In order that the tabs and fingers are uniformly positioned for locating the vanes 34 and for affirmatively engaging the vanes 34, locator holes 100 are provided on the rail 30 for use in the manufacturing operation. It is critical that the strap on the vane is always the same distance from the end of the vane, and the distance (a) between the strap and end of the vane be smaller than the distance (b) from the end of the finger to the base sheet of the rail. If the strap 70 was cut laterally out of the vane too far from the end of the vane, the finger would not reach the opening 83 of the vane and the vane 34 could not be affirmatively coupled to the rail 30 when assembled. Although the finger 84 does affirmatively engage the tab 50 to the vane 34, if addditional security is deemed necessary, a screw or other fastener 102 is provided (see FIG. 4).

As stated above, vane assemblies normally provide a rail at both ends of the vanes. The assembly of rails secures the vanes in parallel relationship until the assembly is inserted into a duct. The rails are then normally fastened to the walls of the duct in which they are placed, aligned from corner to corner as seen in FIG. 1.

Although the present invention has been described with reference to preferred embodiments, workers skilled in the art will recognize that changes may be made in form and detail without departing from the spirit and scope of the invention.

What is claimed is:

1. In combination with an air duct vane comprising a single panel of laterally bowed sheet metal, the improvement which comprises:

the duct vane having a generally lateral strap adjacent a longitudinal end thereof to define a slot therein; and a rail for supporting said duct vane in a generally perpendicular relation thereto, the rail having at least one upstanding tab thereon which is slidably inserted longitudinally into said slot on the vane, with the tab having means for affirmatively engaging the vane adjacent the strap to retain the rail in connected relation to the vane.

2. The invention of claim 1 wherein the duct vane has a plurality of lateral straps adjacent its longitudinal end defining a plurality of slots and the rail has a corresponding plurality of upstanding tabs aligned in an arc for insertion into said slots of the vane.

3. The invention of claim 1 wherein the longitudinal end of the duct vane is a first end and the duct vane has a second longitudinal end longitudinally spaced apart therefrom with a second lateral strap on the vane defining a second slot adjacent the second end thereof, and wherein a second rail is provided for the second end of the vane, the second rail having at least one second upstanding tab thereon which is slidably inserted longitudinally into the second slot in the vane adjacent its second end, with the second tab having means for affirmatively engaging the vane adjacent the second strap to retain the second rail in connected relation thereto, generally parallel to the rail at the first end of the vane.

4. The invention of claim 1 wherein the rail has a plurality of upstanding tabs aligned thereon to support a plurality of generally parallel, spaced apart duct vanes.

5. The invention of claim 1 wherein the strap is formed integrally with the vane from a strip of the vane between two parallel slots cut laterally through the vane, the strap having first and second ends integral with the vane and being spaced outwardly from the vane therebetween thereby leaving a lateral opening in the vane defined by the first and second ends of the strap and the two parallel slots in the vane.

6. The invention of claim 5 wherein the means for engaging is a finger extending outwardly from the tab with the finger being received in the lateral opening in the vane when the tab is inserted into the strap.

7. The invention of claim 6 wherein an outer end of the finger is adapted to engage the slot in the vane closest to the one end of the vane.

8. The invention of claim 6 wherein the finger is formed integrally from the tab.

9. The invention of claim 1 wherein the tab is formed integrally from the rail.

10. A method for assembling a laterally bowed duct vane perpendicularly to a rail having an upstanding tab thereon, the method comprising the steps of:

providing a lateral strap from a panel of the duct vane adjacent a longitudinal end thereof to define a slot therein;

inserting the tab longitudinally into said slot between the vane panel and the lateral strap thereon; and engaging a portion of the tab with a portion of the vane panel adjacent the strap to secure the vane in connected relation to the rail.

11. The method of claim 10, and further comprising the step of:

aligning and connecting a plurality of the duct vanes in generally parallel alignment between two of the rails.

12. The method of claim 10, and further comprising the steps of:

providing a plurality of lateral straps adjacent the longitudinal end of the vane to define a plurality of slots; and providing a plurality of tabs on the rail, with the tabs arranged in an arc, for engagement with respectively aligned slots on the vane.

13. The method of claim 10, wherein the inserting and engaging steps are performed manually.

14. An air duct vane assembly comprising:

a laterally bowed panel, with the panel having generally lateral slot means adjacent each longitudinal end thereof;

rail means for supporting the panel from its longitudinal ends, the rail means having at least one upstanding tab for each end of the panel, with each tab being slidably inserted longitudinally into its respective slots means; and finger means for affirmatively engaging the tab of the rail means in connected relation to the panel.

15. The air duct vane assembly of claim 14 wherein the rail means supports a plurality of panels in generally parallel alignment.

16. The air duct vane assembly of claim 14 wherein a pair of lateral straps at each longitudinal end of the panel define a pair of slots to slidably receive a pair of tabs from the rail means.

* * * * *